US005702053A

United States Patent [19]

Kozakai et al.

[11] Patent Number: 5,702,053

[45] Date of Patent: Dec. 30, 1997

[54] COMPOSITE INSULATOR-PACKING CONTAINER AND A METHOD FOR PACKING A COMPOSITE INSULATOR

[75] Inventors: Motokazu Kozakai, Kasugai City; Kunitoshi Aoyama; Masahiko Sahasi, both of Komaki City, all of Japan

[73] Assignee: NGK Insulators, Ltd., Japan

[21] Appl. No.: 487,689

[22] Filed: Jun. 7, 1995

[30] Foreign Application Priority Data

Sep. 19, 1994 [JP] Japan ..... 6-223086

[51] Int. Cl.[6] ..... B65D 85/02

[52] U.S. Cl. ..... 229/87.02; 53/462; 229/939

[58] Field of Search ..... 229/87.02, 939; 206/328, 418, 446, 587, 594; 53/462, 170, 172; 220/421, 443

[56] References Cited

U.S. PATENT DOCUMENTS

| | | | |
|---|---|---|---|
| 1,234,917 | 7/1917 | McClay | 220/416 |
| 1,568,834 | 1/1926 | Hauge et al. | 229/939 |
| 2,084,922 | 6/1937 | Sidebotham | 229/939 |
| 2,553,923 | 5/1951 | Lambert | 229/87.02 |
| 2,798,596 | 7/1957 | Emons | 206/418 |
| 2,965,280 | 12/1960 | Miller | 220/416 |
| 3,244,353 | 4/1966 | Miessler, Sr. | 229/939 |
| 3,333,756 | 8/1967 | Amatel | 206/418 |
| 3,451,610 | 6/1969 | Beichler et al. | 229/939 |
| 3,772,969 | 11/1973 | Carter | 53/462 |

OTHER PUBLICATIONS

The Wiley Encyclopedia of Packaging Technology, John Wiley & Sons, (1986) pp. 66–69.

*Primary Examiner*—Gary E. Elkins
*Attorney, Agent, or Firm*—Parkhurst,Wendel & Burr,L.L.P.

[57] ABSTRACT

A composite insulator-packing container is made of a single-faced corrugated fiberboard composed of a linerboard and a corrugating medium joined to one surface of the linerboard. The fiberboard is fabricated in a form of a polygonal prism by folding an original single-faced corrugated fiberboard along ruled lines such that the linerboard is located at an outer periphery of said packing container. The ruled lines are orthogonal to flutes of the corrugating medium and are formed such that when the fiberboard is folded along the ruled lines in the form of the polygonal prism, outer peripheries of shade portions formed around a core member of a composite insulator internally touch or are located radially inwardly near inner peripheral sides of the polygonal prism. A method for packing the composite insulator is also disclosed.

7 Claims, 6 Drawing Sheets

COMPOSITE INSULATOR-PACKING CONTAINER AND A METHOD FOR PACKING A COMPOSITE INSULATOR

BACKGROUND OF THE INVENTION

1. Field of the Invention

The present invention relates to a composite insulator-packing container and a method for packing a composite insulator.

2. Prior Art

Insulators have been ordinarily made of porcelain. In recent years, composite insulators using no porcelain have been employed in various uses requiring reduction in weight. As shown in FIG. 1, such a composite insulator includes a rod 1 made of FRP, a number of rubbery shades 2 attached around the outer periphery of the rod 1, and metallic end fittings 3, 4 attached to opposite ends of the rod 1. The composite insulator has an entire length of 2 m to 4 m and a weight of around 15 Kg to around 20 Kg, and has a tendency to warp.

Heretofore, when composite insulators are to be shipped from insulator manufacturers, the insulators are packed with wooden boxes as in the case of ordinary porcelain insulators do so that the composite insulators not warped or get scratched on their surfaces. However, such wooden boxes are not made of cheap materials, and they are heavy themselves. In addition, various wooden boxes must be prepared to meet the composite insulators having various sizes. In view of this, as shown in FIG. 7, a composite insulator has been placed into a paper cylinder 5, and fixed therein by means of a cap 6. However, various paper cylinders and caps must be prepared depending upon the sizes of the composite insulators. Furthermore, as is seen from FIG. 7, the composite insulator must be inserted into the paper cylinder 5 from one end, which requires a wide working space.

SUMMARY OF THE INVENTION

It is an object of the present invention to solve the above-mentioned problems, and to provide a composite insulator-packing container which is made of an inexpensive material and is light in weight and which can meet composite insulators having a variety of sizes and requires no wide packing space. The invention is also to provide a method for producing such a composite insulator-packing container as well as a method for packing the composite insulator.

The composite insulator-packing container according to the present invention, which has been made to solve the above-mentioned problems, includes a single-faced corrugated fiberboard composed of a linerboard and a corrugating medium joined to one surface of said linerboard, said fiberboard being fabricated in a form of a polygonal prism by folding an original single-faced corrugated fiberboard along ruled lines such that the linerboard may be located at an outer peripheral side of said packing container, said ruled lines being orthogonal to flutes of the corrugating medium and being formed such that when said fiberboard is folded along said ruled lines in the form of the polygonal prism, outer peripheries of shade portions formed around a core member of a composite insulator internally touch or are located radially inwardly near inner peripheral sides of the polygonal prism.

According to the composite insulator-packing container of the present invention, since the composite insulator-packing container is constituted by forming ruled lines at a single-faced corrugated fiberboard such that said ruled lines are orthogonal to flutes of the corrugating medium and such that when said fiberboard is folded along said ruled lines in the form of the polygonal prism, outer peripheries of shade portions formed around a core member of a composite insulator internally touch or are located radially inwardly near inner peripheral sides of the polygonal prism, folding the single-faced corrugated fiberboard along the ruled lines to pack the composite insulator, light-weight and inexpensive packing containers can be obtained to cope with a variety of sizes of the composite insulators.

The following are recited as preferred embodiments of the composite insulator-packing container. So long as no discrepancy exists, these preferred embodiments may be arbitrarily combined together also as preferred embodiments.

(1) The composite insulator-packing container is impregnated and reinforced with a resin. By so doing, the strength of the container can be enhanced.

(2) The composite insulator-packing container is of a square prism. By so doing, a plurality of such containers in which the composite insulators are packed can be easily stacked one upon another, which facilitates storage and shipping of the packed composite insulators.

(3) The flutes of the corrugating medium extend in a direction orthogonal to an axis of an insulator to be packed in the container. By so doing, the strength of the container can be enhanced.

(4) At least one outermost end face is overlapped upon a corresponding underside face. By so doing, the strength of the container can be also enhanced.

(5) The one outermost end plane is fixed to corresponding underside portion of the container.

According to the method of packing a composite insulator, the method includes:

① preparing a single-faced corrugated fiberboard composed of a linerboard and a corrugating medium joined to one surface of said linerboard;

② forming ruled lines such that said ruled lines are parallel to one another and substantially orthogonal to flutes of the corrugating medium, said ruled lines being orthogonal to flutes of the corrugating medium and being formed such that when said fiberboard is folded along said ruled lines in the form of the polygonal prism, outer peripheries of shade portions formed around a core member of a composite insulator internally touch or are located radially inwardly near inner peripheral sides of the polygonal prism;

③ placing the composite insulator on the single-faced fiberboard on a side which is to be located inside a packing container; and ④ fabricating said fiberboard in a form of a polygonal column by folding an original single-faced corrugated fiberboard along said ruled lines such that the linerboard may be located at an outer periphery of said packing container.

Since the composite insulator is brought into contact with a soft inner side of the container, it is not feared that the composite insulator is scratched. Furthermore, since the composite insulator is wrapped and packed in the container by folding the fiberboard, no wide space is necessary for the packing work.

The following are preferred embodiments of the method of packing the composite insulator according to the present invention. So long as no discrepancy exists, these preferred embodiments may be arbitrarily combined together as further preferred embodiments.

(1) When the fiberboard is fabricated in said polygonal prism form, opposite side faces of the polygonal column overlap one another.

(2) An outermost side face of the folded fiberboard is bonded to an opposite side face thereof or to a side face facing said outermost side face.

These and other objects, features and advantages of the invention will be appreciated upon reading the following description of the invention when taken in conjunction with the attached drawings, with the understanding that some modifications, variations and changes could be made by the skilled person in the art to which the invention pertains.

BRIEF DESCRIPTION OF THE DRAWINGS

For a better understanding of the invention, reference is made to the attached drawings, wherein:

FIG. 4(*b*) is a perspective view of the composite insulator-packing container of which side faces are each constituted by two walls and which is bonded at an outermost side face with an adhesive tape;

FIG. 4(*c*) is a cap having leg portions to be fitted into container at an end:

FIG. 5(*b*) is a side view showing a state that the composite insulator is packed in the packing container, while being supported by the spacer;

DETAILED DESCRIPTION OF THE INVENTION

The present invention will be explained in more detail with reference to embodiments shown in the attached drawings.

Figure 1:
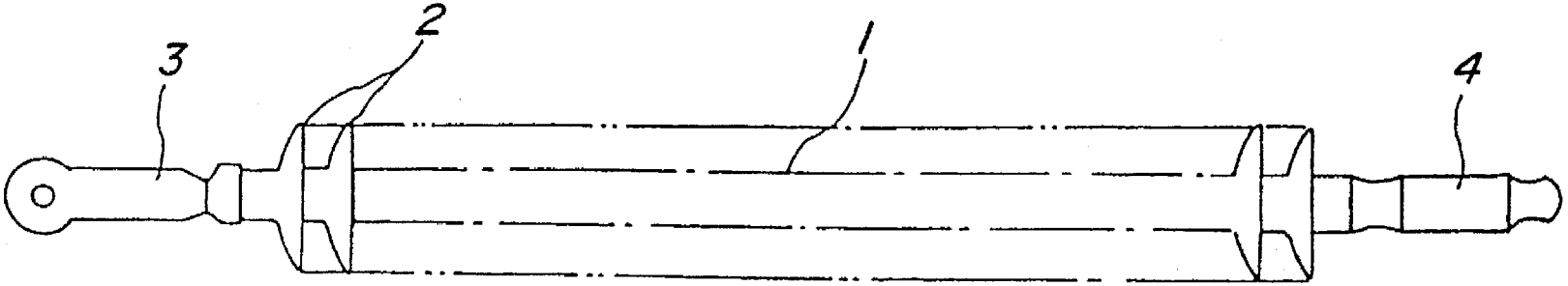
FIG. 1 is a front view of a composite insulator.
Figure 2:
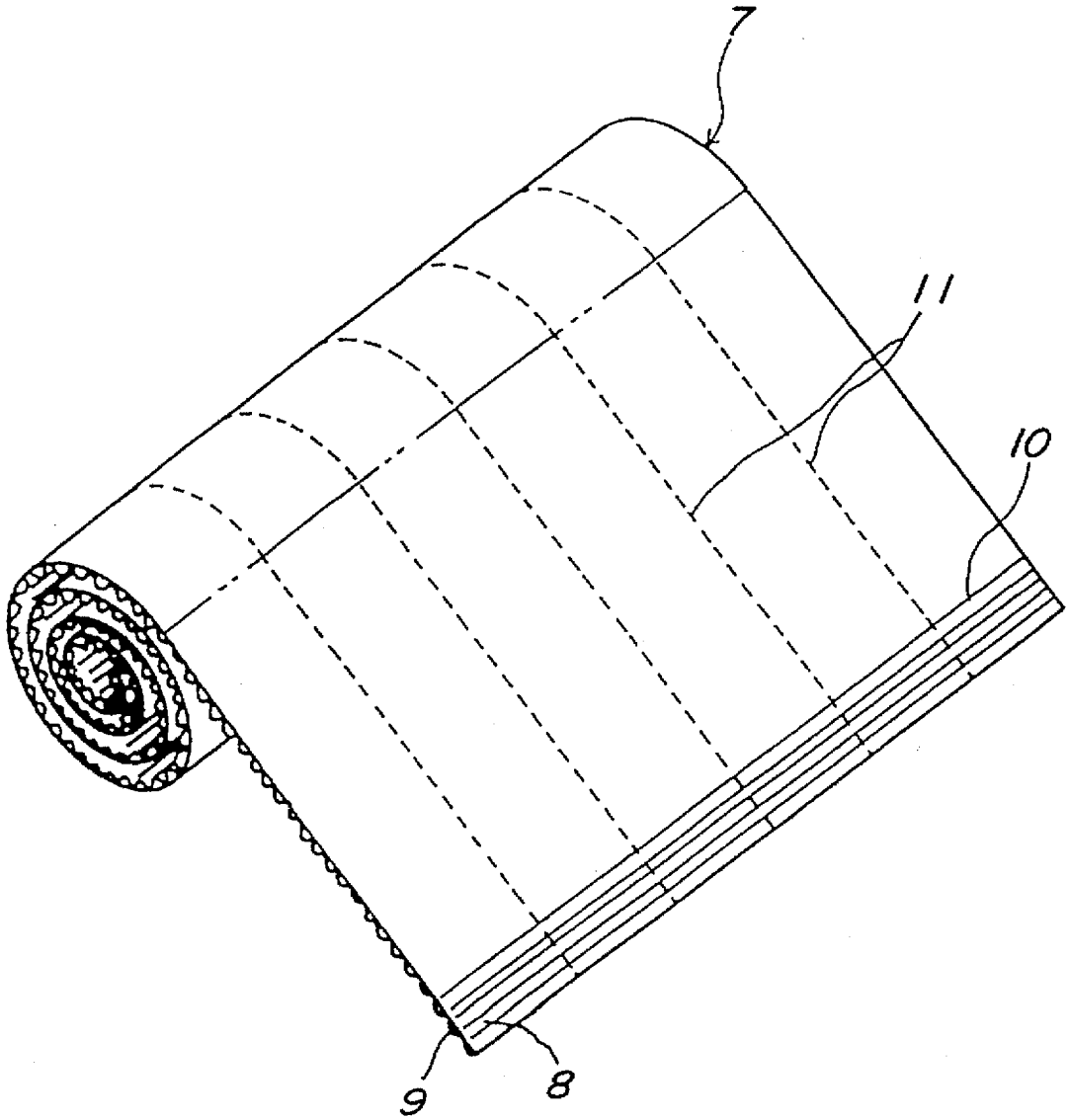
FIG. 2 is a perspective view of a rolled single-faced corrugated fiberboard.

In FIG. 2 is shown the rolled single-faced corrugated fiberboard 7. As well known, the single-faced corrugated fiberboard is constituted by a liner-board 8 and a corrugating medium 9 bonded to one surface of the linerboard 8. As shown in FIG. 2, a number of flutes 10 extend parallel to the axis of the roll.

As mentioned before, since the container is used to pack the composite insulator which has a weight of 15–20 kg and easily warps, the single-faced corrugated fiberboard 7 used in the present invention has some strength and rigidity. For this purpose, the single-faced corrugated fiberboard 7 into which a resin is impregnated and cured is used in this embodiment. More specifically, the single-faced corrugated fiberboard 7 is immersed into an organic solvent in which a polystyrene resin for a few to several hours, followed by drying with air at around 60° C.

A plurality of substantially parallel ruled lines 11 are formed at the single-faced corrugated fiberboard 7 in a direction orthogonal to flutes 10 at such an interval that when the fiberboard is folded along the ruled lines in the form of the polygonal prism, outer peripheries of shade portions formed around a core member of the composite insulator internally touch or are located radially inwardly near inner peripheral sides of the polygonal prism.

The above ruled lines may be formed preliminarily to meet the diameter of the shade portions of the composite insulator during the production of the one-faced corrugated fiberboard or every time when a single-faced corrugated fiberboard is cut and used in a given size for packing. The number of the ruled lines 11 is determined by the width of the single-faced corrugated board 7. The number of the ruled lines may be also determined by considering how may side faces are overlapped with underside faces in the formation of the container. In the embodiment of FIG. 2, five ruled lines 11 are formed.

Figure 3:
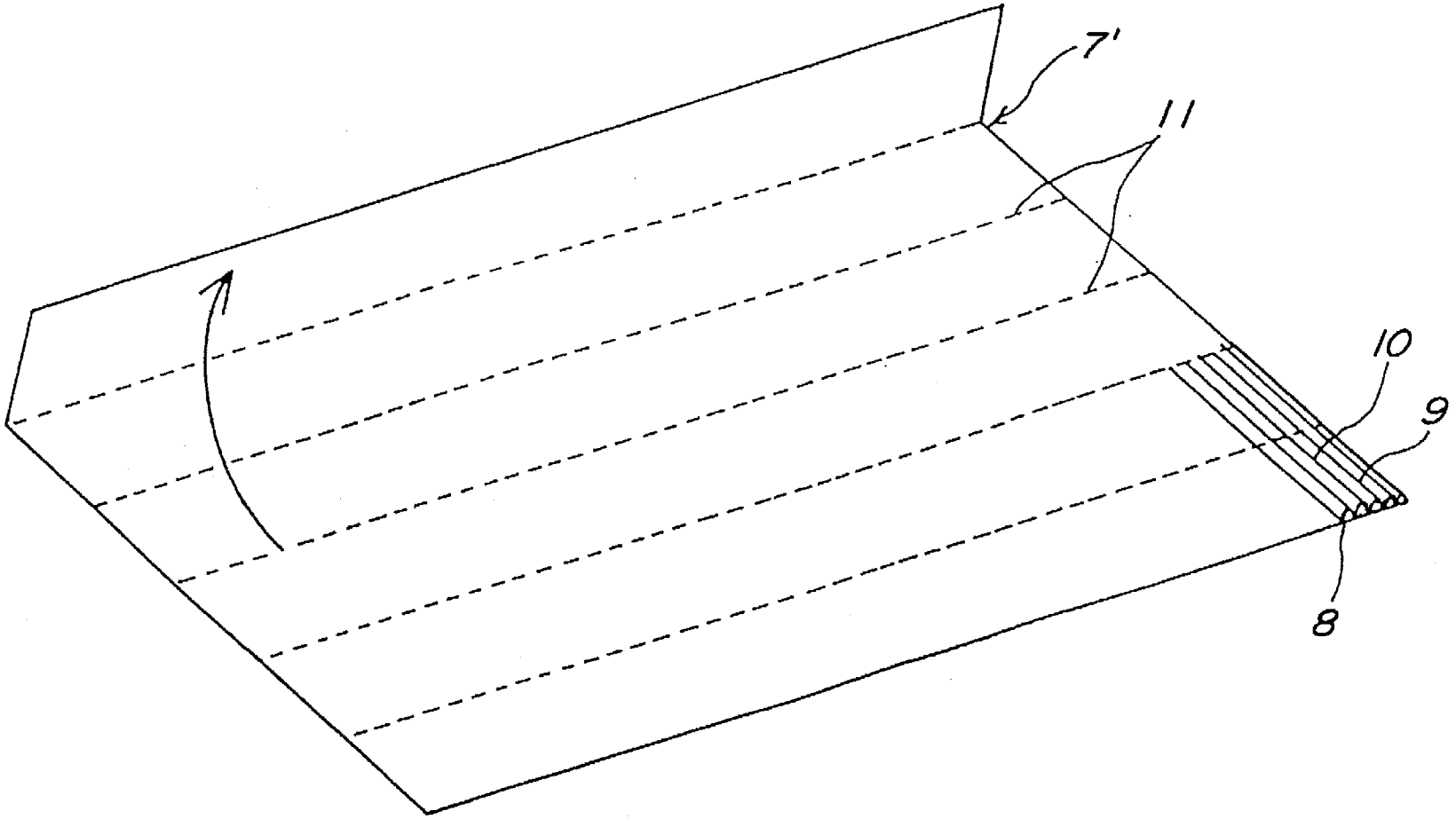
FIG. 3 is a perspective view of a single-faced corrugated fiberboard cut in a given size.
Figure 4A:
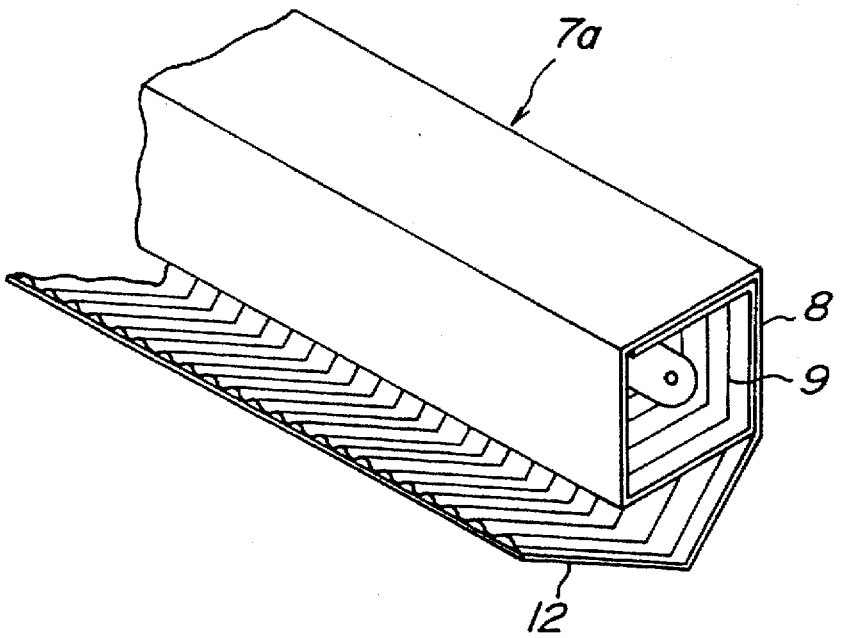
FIG. 4(*a*) is a perspective view for illustrating the formation of a composite insulator-packing container.
Figure 4B:
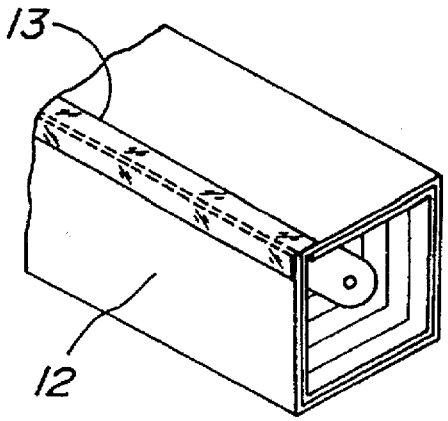
Figure 4C:
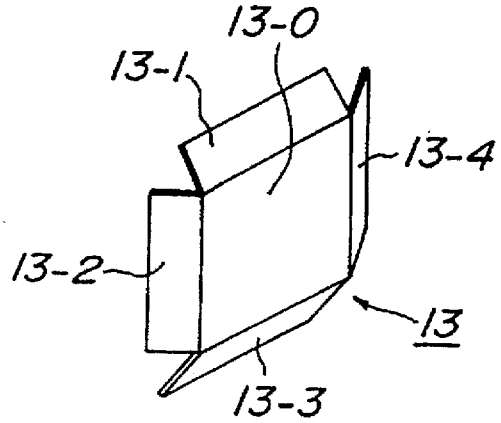

A single-faced corrugated fiberboard 7' is cut in a given size shown in FIG. 3 to meet the length of a single composite insulator (Also see FIG. 2). The fiber-board 7 is cut along a cutting line orthogonal to the rolled direction of the fiberboard 7. Thus, the cut length may be arbitrarily set. The cut single-faced corrugated fiberboard 7' is spread on a floor such that the corrugating medium 9 may be faced upwardly, and the composite insulator is placed such that the composite insulator may be orthogonal to the flutes of the corrugating medium. As shown in FIG. 4(*a*), the composite insulator is wrapped in the cut fiberboard 7' by folding it along the ruled line such that shade portions may contact with the corrugating medium. In this embodiments, the container has a rectangular section, and each side wall is constituted by two side walls of the fiberboard as shown in FIG. 4(*a*). As shown in FIG. 4(*b*), the outermost side face 12 of the fiberboard is fixed to an inner side face with use of an adhesive tape 13. In this embodiment, an unfolded lid 13 is prepared, which has leg portions 13-1, 13-2, 13-3, 13-4 as shown in FIG. 4(*c*). The leg portions 13-1 through 13-4 are inserted along four sides of the container of FIG. 4(*b*), respectively, so that an end face 13-0 may be located at an end opening of the container. The lid 13 may be fixed to the end of the container with use of an appropriate adhesive means. As the material for the lid 13, the same material as that of the composite insulator-packing container according to the present invention may be employed. The thus formed composite insulator-packing container is light in weight, inexpensive and suitable for transportation of the composite insulator.

Figure 5A:
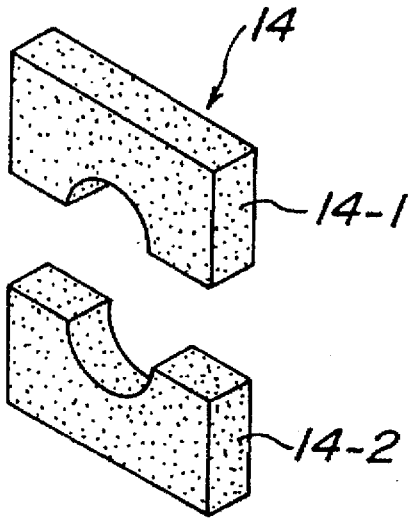
FIG. 5(*a*) is a perspective view of a spacer constituted by a pair of spacer sections between which a core member of the composite insulator is held.
Figure 5B:
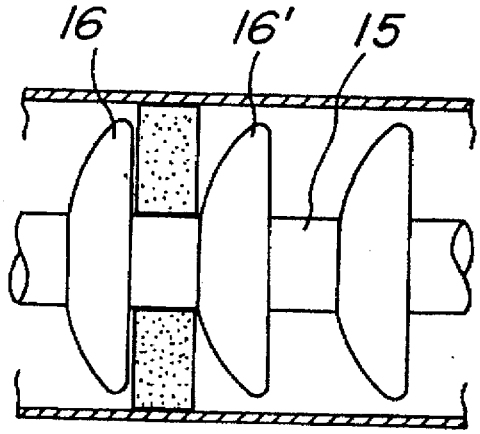

FIG. 5(*a*) illustrates a spacer 14 constituted by a pair of spacer units 14-1, 14-2 for supporting a rod member 15 between adjacent shade portions 16, 16'. When the composite insulator is packed in the container such that the rod member 15 is held and supported by an appropriate number of such spacers 14 between adjacent shade portions 16, 16' (See FIG. 5(*b*)), the composite insulator can be more fixedly and assuredly packed inside the container. Such a spacer may be made of an appropriate material such as foamed resin.

Figure 6:
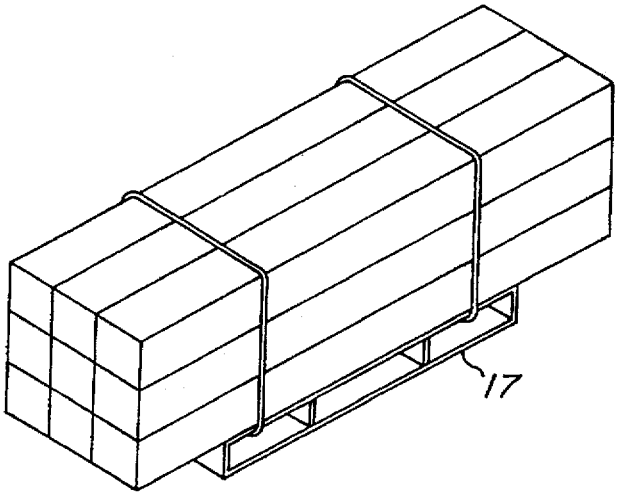
FIG. 6 is a perspective and diagrammatical view of bundled composite insulator-packing containers in which composite insulators are packed.
Figure 7:
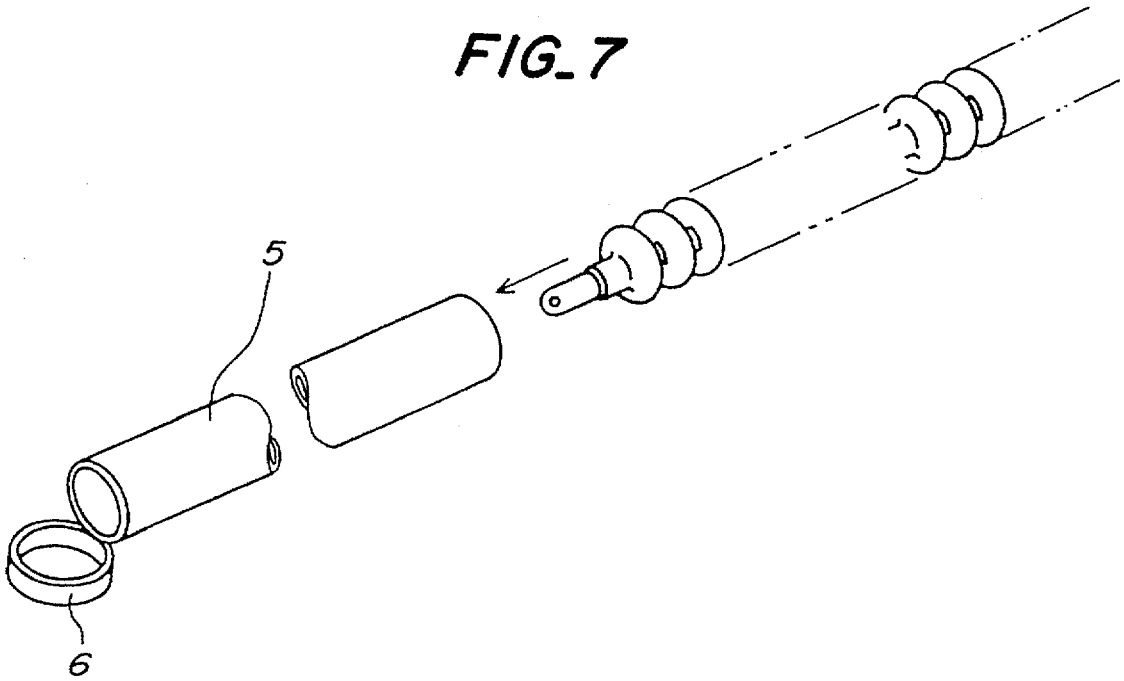
FIG. 7 is a perspective view of illustrating the conventional method of packing the composite insulator with use of a paper cylinder.

FIG. 6 illustrates a group of nine containers in which composite insulators are packed are bundled together, and placed on a frame table 17 into which arms of a fork lift are to be inserted for transportation. As seen from FIG. 6, if the containers have a rectangular section, the containers can be easily stacked one upon another, and bundled together.

As is clear from the aforegoing explanation, the present invention has a variety of advantages mentioned below.

(1) Since single-faced corrugated fiberboard is used, the cost of the material is low.

(2) Since single-faced corrugated fiberboard is used, the weight of the container is lower compared with a wooden box.

(3) Since the single-faced corrugated fiberboard unit for each composite insulator-packing container is formed with only ruled lines and a cut depending upon the diameter of the shade portions and the entire length of the composite insulator, the containers can be easily prepared to meet various sizes of the composite insulators.

(4) Since the composite insulator is supported at the side of the soft corrugating medium, there is no fear that the composite insulator will be damaged or scratched.

(5) The deformation of the composite insulator is prevented by the action of the flutes extending in a direction orthogonal to the ruled lines.

(6) No wide packing space is necessary unlike the case where the composite insulator is inserted into a paper cylinder.

(7) Since the composite insulator-packing container can be folded flat after use, it can be conveniently returned to the insulator manufacturers and recycled.

(8) when the reinforced single-faced corrugated fiberboard is used for the container, the container can be prevented from being deformed during transportation of the insulator.

What is claimed is:

1. A packing container, comprising:

a single-faced corrugated fiberboard composed of a linerboard and a corrugating medium joined to one surface of said linerboard, said fiberboard being impregnated and reinforced with a resin and being folded into a shape of a polygonal prism along ruled lines orthogonal to flutes of said corrugating medium such that said linerboard is located at an outer periphery of said packing container, said flutes of said corrugating medium extending in a direction perpendicular to a longitudinal axis of said packing container.

2. The composite insulator-packing container set forth in claim 1, which is of a square prism.

3. The packing container set forth in claim 1, wherein at least one end portion of said fiberboard fully overlaps a corresponding entire face portion of said linerboard on said outer periphery of said packing container.

4. The packing container set forth in claim 3, wherein said end portion of said fiberboard is fixed to the corresponding face portion of said linerboard.

5. A method of packing an insulator inside corrugated fiberboard, said method comprising:

(1) preparing a single-faced corrugated fiberboard composed of a linerboard and a corrugating medium joined to one surface of said linerboard;

(2) forming ruled lines such that said ruled lines are parallel to one another and substantially orthogonal to flutes of the corrugating medium such that when said fiberboard is folded along said ruled lines in a form of a polygonal prism, outer peripheries of shade portions of an insulator formed around a core member internally touch or are located radially inwardly near inner peripheral sides of the polygonal prism;

(3) placing an insulator on the single-faced fiberboard on a side which is to be located inside a packing container; and (4) folding said fiberboard in the form of the polygonal prism along said ruled lines such that the linerboard is located at an outer periphery of said packing container.

6. The method of packing an insulator set forth in claim 5, wherein when said fiberboard is folded in said polygonal prism form, opposite side faces of the polygonal prism overlap one another.

7. The method of packing an insulator set forth in claim 5, further comprising bonding an outermost side face of the folded fiberboard to one of at least an opposite side face thereof and to a side face facing said outermost side face.

* * * * *